US006085850A

United States Patent [19]

Phillips

[11] Patent Number: 6,085,850

[45] Date of Patent: Jul. 11, 2000

[54] MINIATURE IMPACT TOOL

[76] Inventor: Raymond J. Phillips, 67 Wawecus Hill Rd., Bozrah, Conn. 06334

[21] Appl. No.: 09/420,250

[22] Filed: Oct. 19, 1999

Related U.S. Application Data

[63] Continuation-in-part of application No. 09/128,518, Aug. 3, 1998, abandoned, which is a continuation-in-part of application No. 08/846,888, May 1, 1997, Pat. No. 5,803,183.

[51] Int. Cl.[7] ..... B25D 11/10

[52] U.S. Cl. ..... 173/203; 173/120; 173/205; 30/167

[58] Field of Search ..... 173/203, 205, 173/47, 48, 120; 30/167, 168

[56] References Cited

U.S. PATENT DOCUMENTS

| | | | |
|---|---|---|---|
| 3,022,838 | 2/1962 | Mitchell | 173/120 |
| 3,074,155 | 1/1963 | Cootes et al. | 173/120 |
| 3,874,460 | 4/1975 | Schmid et al. | 173/48 |
| 5,427,188 | 6/1995 | Fisher | 173/205 |

*Primary Examiner*—Scott A. Smith

[57] ABSTRACT

A miniature impact tool in which a cam and cam follower assembly is utilized for moving a striker backward by converting rotary motion of a drive shaft to a linear motion. The striker is in contact with a spring/guide pin (plunger) assembly and is moved away from a surface to be struck during a portion of the rotation cycle of the cam. On further rotation the cam surface is cut away and spring action drives the striker forward, causing impact of a cutting tool (chisel) against a workpiece. A plurality of cam lobe surfaces provides predetermined and reproducible impact forces of the cutting tool on the workpiece, even during vibration of the tool. To minimize damage to the cam and cam follower when the tool is over speeded, an elastomeric cam or a cushioning coating or sleeve prevents adverse contact (such as metal-to-metal contact) between the cam and cam follower.

26 Claims, 5 Drawing Sheets

FIG. 3
PRIOR ART
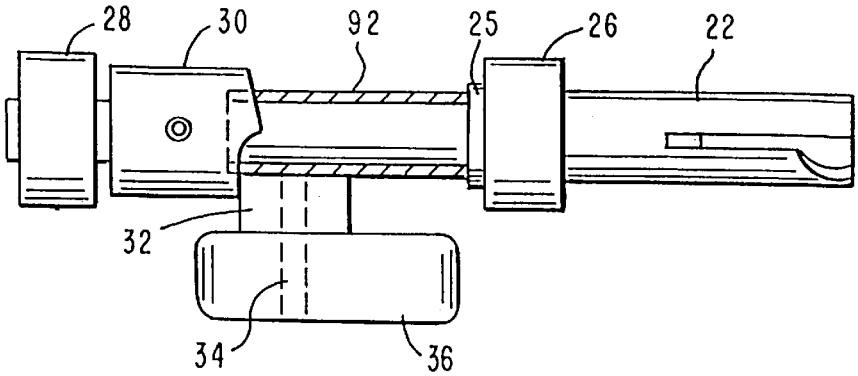
FIG. 4
PRIOR ART
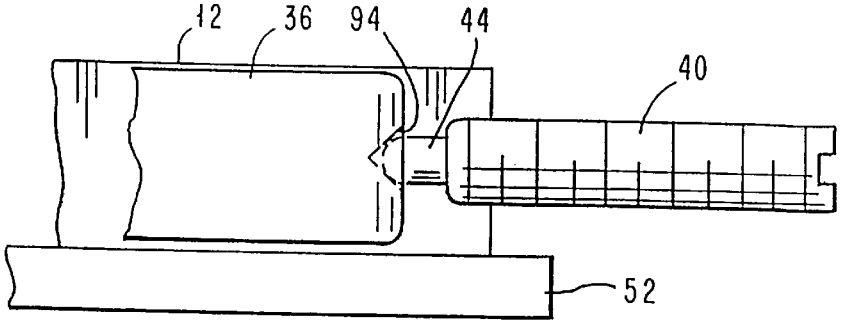
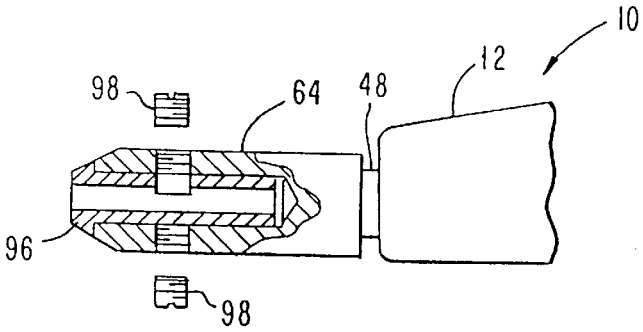
FIG. 5
PRIOR ART
FIG. 6
PRIOR ART
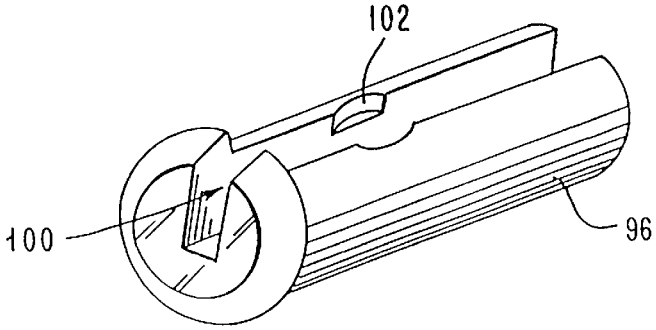

SIDE VIEW

BOTTOM VIEW

MINIATURE IMPACT TOOL

CROSS REFERENCE TO RELATED APPLICATIONS

This application is a continuation-in-part of patent application Ser. No. 09/128,518, filed Aug. 3, 1998, now abandoned, which is a continuation-in-part of Ser. No. 08/846,888, filed May 1, 1997, now U.S. Pat. No. 5,803,183. U.S. Pat. Nos. 4,030,556 and 5,449,044 and application Ser. No. 08/846,888 (now U.S. Pat. No. 5,803,183) filed May 1, 1997.

BACKGROUND OF THE INVENTION

1. Field of the Invention

This invention relates to an improved miniature impact tool of the type which is a hand-held mechanically operated tool for use in engraving and other applications, and more particularly to such a tool in which an improved mechanism is provided for delivery of intermittent force impulses to a chisel engraving tool.

2. Background Art

My previous patents, U.S. Pat. No. 4,030,556 and U.S. Pat. No. 5,449,044, and my copending application Ser. No. 08/846,888 (U.S. Pat. No. 5,803,183) describe a miniature tool that is particularly suited for applications such as engraving, chipping, die making, dental and orthopaedic surgery, sculpting, carving, riveting, etc. This is a hand-held impact tool in which rotary motion is converted to linear motion wherein intermittent force is applied to a striker causing it to impact on (contact) a chisel tool held in contact with a workpiece. A drive portion of the miniature tool converts rotary motion to linear motion by means of a cam interface. A spring and plunger arrangement is used to provide the intermittent force which is delivered to a striker that contacts a chisel tool holder. Due to the compressive force of the spring, the striker will provide a sharp blow to the tool holder causing the tool to chip or carve or otherwise impact on the intended workpiece. This cycle is continually repeated as the cam is caused to rotate against a bearing surface connected to the striker.

The entire contents of U.S. Pat. Nos. 4,030,556 and 5,449,044 and copending application Ser. No. 08/846,888 are incorporated herein by reference. Pertinent portions thereof will also be reviewed in the description of the preferred embodiments of this invention.

Copending application Ser. No. 08/846,888 is based on a recognition of a potential problem in a portion of the miniature impact tool of my previous U.S. Pat. Nos. 4,030,556 and 5,449,044. Based on my experimentation and use of this impact tool, I had found that the spring plunger assembly used to provide force impulses to a hammer (or striker) did not always provide impulses having approximately constant (uniform) amplitudes. Further, the screw type adjustments used to provide force impulses of different amplitude did not, for reasons of vibration and wear, work well to maintain the magnitude of the applied impact force. In turn, this affects the speed with which engraving can be done and the reproducibility of repeated engraving operations. It may also adversely affect the precision of the engraving.

I have now found that when the tool is over speeded a problem can occur which will cause damage to the cam surface and other components used to convert rotary motion to linear motion of the striker. In turn, this will limit the useful life of the tool and will necessitate a repair. My present invention addresses this situation.

Accordingly, it is a primary object of this invention to provide a miniature impact tool of the general type described in my previous U.S. Pat. Nos. 4,030,556 and 5,449,044 and in copending application Ser. No. 08/846,888 in which the assembly providing intermittent force impulses is improved.

It is another object of this invention to provide an improved tool of the general type described in my cited U.S. patents and copending application Ser. No. 08/846,888 which achieves more reliable and precise engraving under various conditions of tool operation.

It is another object of this invention to provide an improved tool of the type described in my above cited patents and copending application in which the features of compactness, light weight, and ability to be hand-held are maintained while providing an efficient tool that delivers intermittent force impulses of a predetermined magnitude over extended periods of use.

It is another object of this invention to provide a miniature impact tool of the general type described in my above cited U.S. patents and copending application that is more tolerant of an over speeding condition in the use of the tool.

SUMMARY OF THE INVENTION

As with my previous miniature impact tools, the present tool converts input rotary motion to linear motion, where the linear motion is repeatedly applied to a striker (hammer) causing the striker to move in a first direction against a plunger (guide pin/spring) assembly, thereby producing a tension (compressive force) on the spring. When the force causing the striker to move in that direction is released, the energy of the spring is rapidly imparted to the striker, causing the striker to move forward and strike a sharp blow against an output shaft holding the chisel tool. Conversion of the input rotary motion to linear motion is achieved by using a cam interface where a plurality of bearing surfaces are employed to ease the friction associated with the rotary motion.

In the design set forth in U.S. Pat. No. 4,030,556, the striker can rise or move slightly upward at its forward end where a cam/needle-bearing assembly is located. In order to prevent this slight "cocking" of the striker and bearing assembly, U.S. Pat. No. 5,449,044 describes an extended shelf above the striker in order to limit striker movement in a vertical direction transverse to the intended back and forth longitudinal movement of the striker. The extended shelf covers most of the top surface area of the striker, having an opening only large enough to allow the needle bearing to move freely back and forth when driven by the cam.

As a further aid to reducing wear on the drive shaft connected to the source of input rotary motion, U.S. Pat. No. 5,449,044 describes a sleeve bearing having a running fit to the drive shaft which surrounds the drive shaft and prevents any wear due to a rise of the needle bearing against the drive shaft. This complements the action of the extended shelf located over the striker assembly, so that wear on the drive shaft is substantially eliminated. In order to alleviate the problem wherein the striker can move from side to side as well as up and down when actuated by the spring-plunger assembly, a recess (guide means), such as a generally conical depression, is provided in the rear surface of the striker, i.e., the surface that is contacted by the plunger. This is shown in U.S. Pat. No. 5,449,044. The nose of the spring-plunger rests in this depression providing alignment of the plunger and striker. This minimizes up and down motion (as well as side-to-side motion) of the striker within the confines of the striker cavity, thereby minimizing friction between the striker and the surrounding surfaces. Because of this, a greater impact will be delivered to the chisel, thereby making the impact tool more efficient.

The chisel-holding end of the tool allows collets of different types to be inserted into the chisel-holding end. This allows the tool to accept chisels having shanks of different shapes including round, rectangular, square, triangular, etc.

The invention described in copending application Ser. No. 08/846,888 improves the spring-plunger assembly used in the impact tools of U.S. Pat. No. 4,030,556 and U.S. Pat. No. 5,449,044 in a manner that allow the magnitude of the intermittent force impulses to be easily changed depending on the engraving or chiselling task to be undertaken. A plunger, or guide pin having a spring around its shaft, includes a spring guide that seats against a cam that can be manually rotated to various positions to increase or decrease the compressive force on the spring. Based on the design of the spring guide and the cam, the cam will not self rotate due to vibration of the tool. This ensures that substantially the same magnitude of force impulse will impact the striker during each successive cycle of operation.

The present invention minimizes damage to the cam and striker assembly, as can be caused when the tool is over-speeded. A cushioning means is used to prevent adverse contact (such as metal to metal contact) between the cam and the striker assembly when the striker rapidly moves in a forward direction toward the output shaft.

These and other objects, features and advantages will be apparent from the following detailed description of the preferred embodiments.

BRIEF DESCRIPTION OF THE DRAWINGS

FIG. 3 is an illustration of a portion of the apparatus of FIG. 1, in which a sleeve bearing is located around the drive shaft in order to eliminate any war of the drive shaft due to bearing rise. This is used in combination with the structure of FIG. 2 to greatly minimize wear and to provide more efficient impact delivery to the cutting chisel.

FIG. 4 is a schematic illustration of the striker/plunger assembly of U.S. Pat. No. 5,449,044 in which the striker contains a guide means such as a groove or recess into which the nose of the spring-plunger fits in order to provide more controlled longitudinal motion of the striker for minimizing friction with the adjacent surfaces.

FIG. 5 shows the chisel-holding end of the impact tool of U.S. Pat. No. 5,449,044, where the output shaft of the tool includes a flanged portion into which a collet can be inserted.

FIG. 6 illustrates a suitable collet for use in this impact tool.

DETAILED DESCRIPTION OF THE PREFERRED EMBODIMENTS

Figure 1:
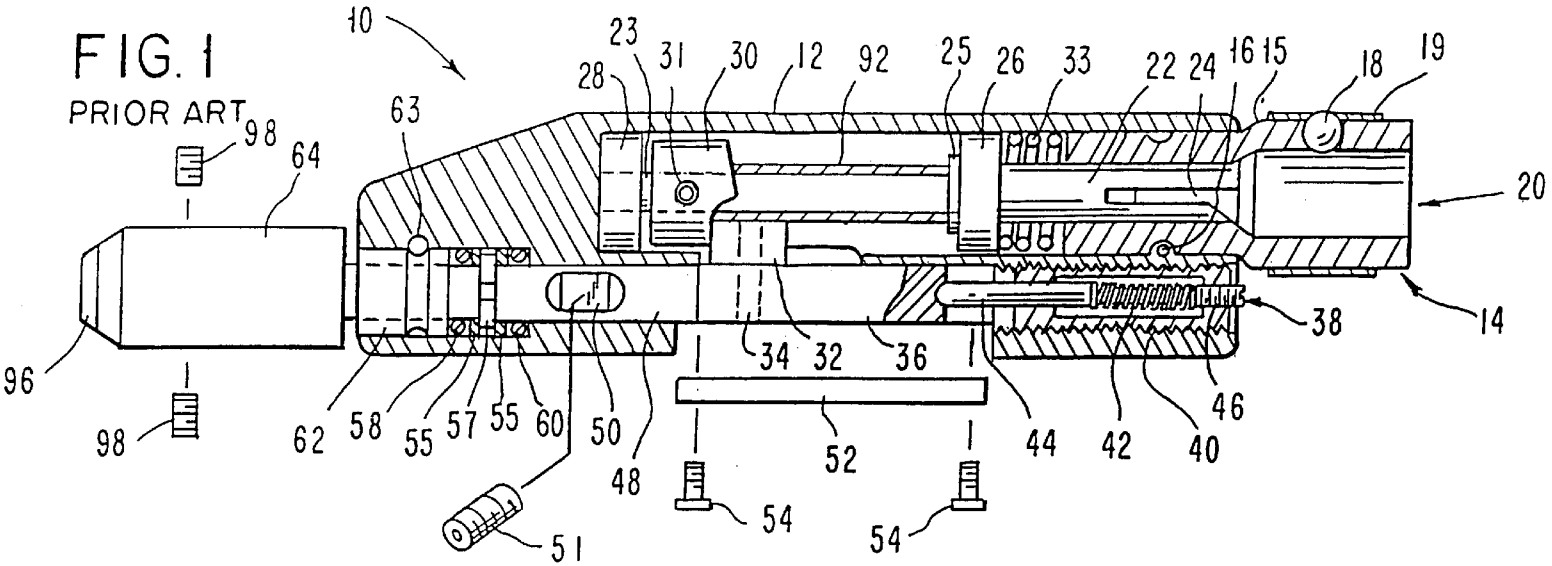
FIG. 1 PRIOR ART
FIG. 1 is a cutaway view of the miniature impact tool of U.S. Pat. No. 5,449,044, illustrating the various structural features of the tool.

FIG. 1 is a cut-away view showing the miniature impact tool 10 of U.S. Pat. No. 5,449,044. This design is a modification of the structure generally shown in FIG. 1 of U.S. Pat. No. 4,030,556. Tool 10 includes a housing 12 having at its aft end a drive shaft retainer 14 including a flanged portion 15. A rotary drive is inserted into the aperture 20 of flanged portion 15. At the fore end of tool 10 the output shaft 48 includes a flanged cylindrical portion 64 into which a cutting tool or chisel is inserted. The center portion of the tool contains a means for converting rotary drive motion into reciprocal horizontal longitudinal motion, in order to cause a striker 36 to impact the output shaft 48 in order to drive the cutting tool or chisel forward.

Drive shaft retainer 14 is held in a fixed position in housing 12 by a spring pin 16. As an alternative, the drive shaft retainer 14 can be threaded for screwing it into housing 12. Aperture 20 is adapted for holding a rotary drive such as a cable (not shown) that is secured to a shaft 22 with a slot 24 for mating with the rotary drive. The means for holding the rotary drive cable is conventionally well known, and includes the ball bearing 18 that is retained in place by the spring band 19. In operation, a small amount of force is used to insert the retaining sleeve of the drive cable into aperture 20, and to remove it therefrom.

Shaft 22 has ball bearing assemblies 26 and 28 thereon wherein bearing 26 is held in place by snap ring 25. Ball bearing assembly 28 is disposed between shaft 22 and the interior wall of housing 12. A cam 30 is affixed to shaft 22 by the retaining spring pin 31. A small shoulder 23 on the forward end of cam 30 abuts the inner rail of bearing 28. Located between the forward end of drive shaft retainer 14 and the bearing assembly 26 is a spring assembly 33 that is used to bias the cam 30 in the forward direction. The following will explain how spring 33 biases the cam 30 in the forward direction. The drive shaft retainer 14 is held in fixed position in the housing 12 by the spring pin 16. Retainer 14 is not fixed to the shaft 22 and the cam 30. Since the aft end of the spring 33 pushes against the retainer 14, which is fixed in the body 12, and since the forward end of spring 33 abuts bearing 26, spring 33 will bias the drive shaft 22 in a forward direction. Bearing 26 abuts against the shoulder of a larger diameter section of drive shaft 22, and is held in place by the snap ring 25. Since the aft end of spring 33 pushes against the retainer 14 which is held in place in body 12, and also pushes against the bearing 26 which is held in place by spring pin 25, shaft 22 will be biased in a forward direction.

Cam 30 is affixed to shaft 22 by the pin 31. The forward end of shaft 22 goes through bearing 28. The opening in housing 12 to accommodate bearing 28 is generally a drilled opening which provides a conical recess in the housing. Shaft 22 is placed forward in bearing 28 and protrudes slightly in the conical end of this drilled recess.

Bearing assembly 32 functions as a cam follower and is affixed to a pin 34. Pin 34 is secured to a striker 36 using a press-fit.

A spring-plunger assembly 38 is located aft of the striker 36, the spring-plunger assembly being used to drive the striker forward during operation of the miniature impact tool. Spring-plunger assembly 38 includes a threaded body 40 which is screwed into a portion of housing 12. Within body 40 is a spring 42 connected to the plunger 44. A spring retainer screw 46 located within the body of assembly 38 is used to adjust the tension of spring 42. The impact of striker 36 upon output shaft 48 may be increased either by screwing the plunger assembly 38 further inward, or by increasing the tension of the internal spring 42 using spring retainer screw 46.

Output shaft 48 has a flattened portion 50 against which a screw 51 can abut in order to prevent rotation of shaft 48. Bottom plate 52 is secured to housing 12 using a plurality of screws 54. Two washers 55 and a retaining ring 57 surround output shaft 48. O-rings 58 and 60 are located adjacent to washers 55 and are elastomeric cushioning rings that provide isolation. That is, these O-rings suspend, or float, tool holder shaft 48 longitudinally (i.e., in a direction along the shaft axis) so that maximum impact is transferred from the striker 36 to the tool tip without dislodging shaft 48 from body 12. Retaining ring 57 prevents the washers 55 and O-rings 58, 60 from moving fore and aft during operation of tool 10. The combination of the O-rings, washers and retaining ring prevents excess longitudinal movement of shaft 48, but does not prevent all longitudinal movement of this shaft.

A bushing 62 is secured in place by a cross pin or spring ring 63. Bushing 62 holds the output shaft 48 in place during operation, allowing the shaft 48 to slide within it. The flanged cylindrical portion 64 of output shaft 48 is bored out to accept a collet 96, which in turn is held in place by the collet retaining screw 98.

Since shaft 22 is pushed forward only by the action of bias spring 33, cam 30 will be biased in a forward direction. As the shaft 22 rotates, cam 30 rides against the needle bearing 32. However, during a small portion (approximately ¼) of the rotation of cam 30, the cam will not contact needle bearing 32. This is the time during which spring 42 causes forward motion of the hammer 36 which impacts against the end of the output shaft 48. In this manner, the hammer impact is transferred to the output shaft 48, rather than to the cam 30. In turn, this ensures that the needle bearing 32 will not be damaged. Because the cam has a particularly shaped surface, and because the cam is biased forwardly by spring 33, the cam 30 and needle bearing 32 will not be in contact when the hammer is impacted forward against the output shaft 48, thereby preventing damage to the needle bearing 32.

Dashed lines indicate the slidable contact between the output shaft 48 and the bushing 62. This is a conventional way to show such contact. Dashed lines are also used to indicate the drive shaft 22, as it goes through the bearings 26 and 28, as well as through the cam 30.

In operation, a rotary unit is affixed to drive shaft 22 through aperture 20, causing shaft 22 and can 30 to rotate. The rotation of cam 30 places a force against bearing 32 and pin 34, causing the striker (hammer) 36 and plunger 44 to retract against the spring 42, compressing spring 42. When bearing 32 rides beyond the raised portion of cam 30, the force against bearing 32 is released thereby causing spring 42 to move plunger 44 and striker 36 forward. Striker 36 then hits tool holder 48, delivering a sharp blow. This drives the chisel against the workpiece, causing the cutting action. This cycle is then repeated in order to continue the cutting operation. Thus, this miniature tool is characterized by a drive mechanism that converts a rotary motion to a linear motion through the use of a cam acting on a spring-loaded device.

Figure 2:
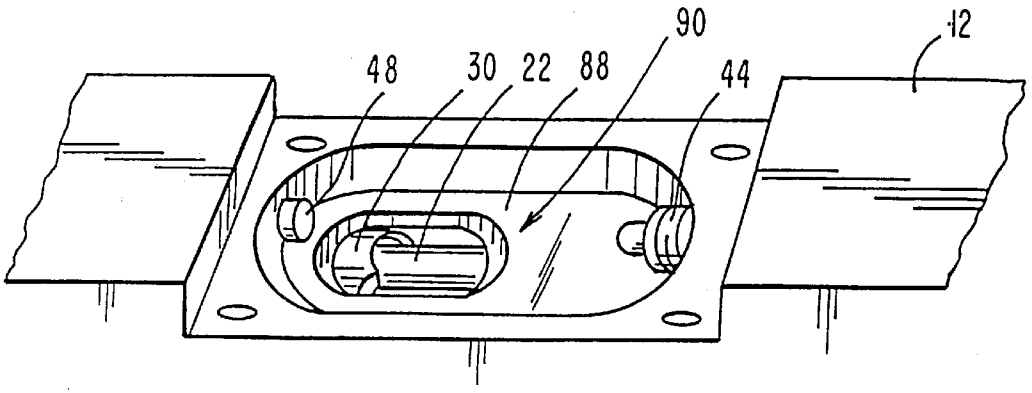
FIG. 2 PRIOR ART
FIG. 2 illustrates a portion of the apparatus of FIG. 1, showing the extended shelf area abutting the striker which provides additional support along its length.

FIG. 2 illustrates a portion of the tool of U.S. Pat. No. 5,449,044 (turned upside down) with cover plate 52 removed to expose the recess in which the striker (not shown) is located, as well as a portion of plunger 44. Striker 36 would rest on a shelf 88 which extends over a large area, in order to support the striker along a substantial portion of its length. This helps to prevent the striker from rising upward at its forward end (bearing 32 end), which may cause the needle bearing 32 to touch drive shaft 22. Shelf 88 has an opening 90 which is only large enough to accommodate the back and forth movement of needle bearing 32. This provides support for the striker at its front and back, as well as along the sides, thereby preventing the striker from moving in a vertical direction transverse to its intended longitudinal movement—i.e., it prevents the striker from moving in a direction toward drive shaft 22.

FIG. 3 schematically illustrates a feature that is used in combination with the shelf area design of FIG. 2 in order to minimize wear on drive shaft 22. Since manufacturing tolerances may still allow or cause the needle bearing 32 to occasionally rise, even if the extended shelf area of FIG. 2 is used, a bearing sleeve 92 is provided. Bearing sleeve 92 has a running fit on drive shaft 22 as shown, and will eliminate any wear due to bearing 32 "rise". Sleeve bearing 92 can be made of molybdenum filled nylon or other materials. Components such as cam 30, output shaft 48, striker 36 and drive shaft 22 are typically made of suitable steel, which may be appropriately heat treated as needed.

The striker 36 can sometimes rub against the cover plate 52 and the inner surfaces of housing 12 during tool operation. The design of FIG. 4 uses a guide means to eliminate much of the errant motion of striker 36 to thereby minimize friction with the surrounding surfaces. In a particular embodiment, the striker has a depression or recess 94 into which the tip or nose of the spring-driven plunger 44 fits. Recess 94 can be of a generally conical shape and is so located that the rear end of the striker is suspended between the inner surfaces of the cover plate 52 and the housing 12, and also between the side surfaces (not shown) of the striker cavity. This reduces friction during movement of the striker and therefore increases the impact of the striker against the tool holder, making the tool more efficient.

In general, recess 94 has a shape designed to accommodate the shape of the nose of the plunger 44 in order to minimize both up-and-down and side-to-side motion of the striker. For most plungers which have a generally conical or rounded nose shape, a conical depression works well. As an alternative to a recess, a hollow cylindrical plunger guide can extend outwardly from the rear surface of striker 36. The tip or nose of the plunger 44 would enter this guide structure to provide alignment of the plunger and striker.

FIG. 5 is an illustration of the fore end of the tool of FIG. 1, where the cylindrical portion 64 of the output shaft 48 has been modified to accept a collet 96. Collet 96 is held within the output shaft 48 by set screw 98. By providing a design in which different types of collets 96 can be secured in output shaft 48, tool 10 can accommodate chisels having different shank geometries. A representative collet is shown in FIG. 6, where the collet 96 has a rectangular slot 100 for accommodating chisel shanks of rectangular shape. A recess 102 is provided as needed for clearance of the upper set screw 98. Other collets can be used to accommodate chisel shanks of any shape, such as rectangular, square, round, etc.

FIGS. 7–10 illustrate the improved mechanism (described in copending application Ser. No. 08/846,888) that replaced the spring-plunger assembly 38 illustrated in FIG. 1. The rest of the components of FIG. 1 remain in the tool 10. This new mechanism provides a means for adjusting the magnitude of the intermittent impulse forces applied to the hammer or striker 36, and therefore to the chisel tool that contacts the workpiece during operation of the tool.

Figure 7:
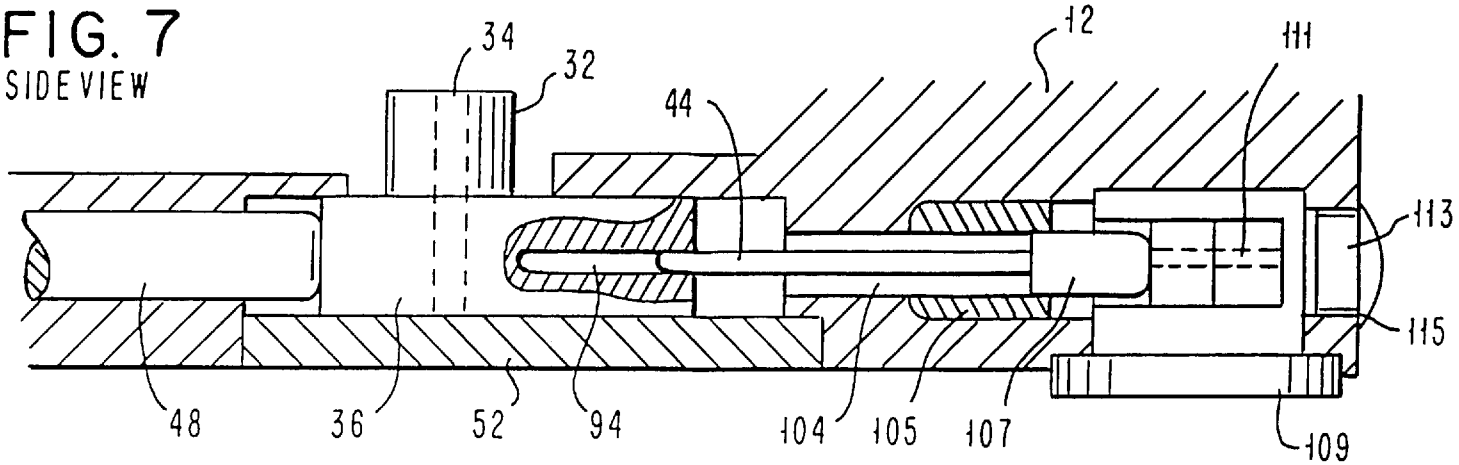
FIG. 7 is a side cut-away portion of the tool of FIG. 1, where the spring-plunger assembly has been replaced by an improved mechanism for providing force impulses to the chisel tool.

Referring to FIG. 7, components which are functionally the same as those in FIG. 1 will be designated by the same reference numerals. Thus, tool body 12, spring 42, guide pin (plunger) 44, output shaft 48, cover plate 52 and striker 36 are the same as in FIGS. 1–6. The only difference is with respect to the striker 36, in which the recess 94 is shown as extending a greater distance into the striker body in FIG. 7 than is shown in FIG. 4.

Although it is not shown in FIG. 7 for ease of illustration, a spring 42 (FIG. 8) surrounds guide pin (plunger) 44 and occupies space 104. A spring guide bushing 105 accommodates sliding fore and aft motion of the spring guide 107 at the aft end of guide pin 44. Spring guide 107 has a flat surface at its aft end which abuts against a flat portion of the thumbwheel cam 109. An opening 111 extends through the thumbwheel cam 109. A compression tool is inserted in the recess 115 (FIG. 7) so as to compress part 107, which will allow thumbwheel 109 to be partially inserted into its recess. The compression tool is then removed so that thumbwheel 109 can be fully seated. Opening 111 accommodates a disassembly tool inserted therein for removal of thumbwheel cam 109 during any subsequent disassembly. A dust cap 113 is used to plug the opening 115 in the tool body that allows access to the hole 111. As will be seen in FIG. 8, spring 42 surrounds the cylindrical shaft of guide pin 44 and is butted against the fore end (shoulder) of spring guide 107 and the aft (rear) end of striker 36. Depending on the tension (compressive force) on spring 42, different amounts of impact force will be imparted to output shaft 48.

Figure 8:
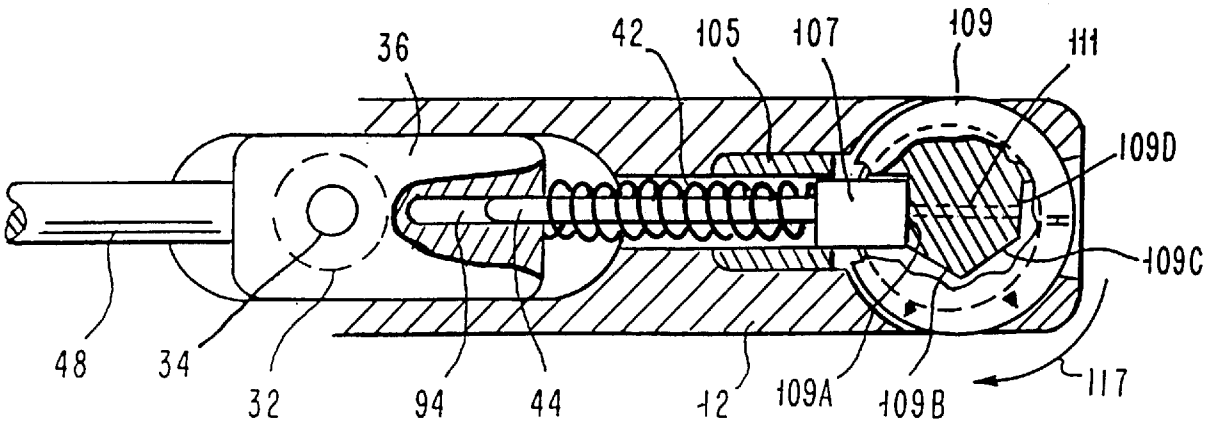
FIG. 8 is a bottom view of the mechanism of FIG. 7, showing the various cam lobes of the thumb wheel that is used to adjust the magnitude of the force impulses delivered to the chisel tool.

FIG. 8 is a sectional bottom view of the assembly shown in FIG. 7, but without the cover plate 52. As noted, the spring 42 is shown in this view. Also, the thumbwheel cam 109 is sectioned to show the (four) cam lobes 109A, 109B, 109C and 109D which are used to provide different compressive forces in spring 42. In this view, the aft end of spring guide 107 abuts cam lobe 109A. By turning the thumbwheel cam 109 in the direction of arrow 117, different cam lobes can be advanced in order to change the distance between cam 109 and striker 36, thereby providing different amounts of compression in spring 42. Generally, rotation of the thumbwheel cam in the direction of arrow 117 will increase the compressive force on the spring as the spring 42 is pushed backwards by the movement of needle bearing 32. In turn, this will cause a greater impact of the hammer 36 onto the output shaft 48 when the spring 42 moves in the forward direction.

Since the rearmost surface of the spring guide 107 is flat, and abuts a flat mating surface on a cam lobe 109A–109D, there is no tendency of the thumbwheel to self rotate or change position because of the vibration of the tool. This is an improvement over the tools of U.S. Pat. No. 4,030,556 and U.S. Pat. No. 5,449,044 where vibration could possibly cause changes in the compressive stress on the spring in the spring-plunger assembly. This could adversely affect the engraving of a workpiece and could also adversely affect the ability to obtain reproducible engraving from one workpiece to the next. The design of the spring guide 107 and thumbwheel cam 109 eliminates the need for a detent arrangement that would prevent the thumb wheel cam from changing position because of vibration.

Figure 9:
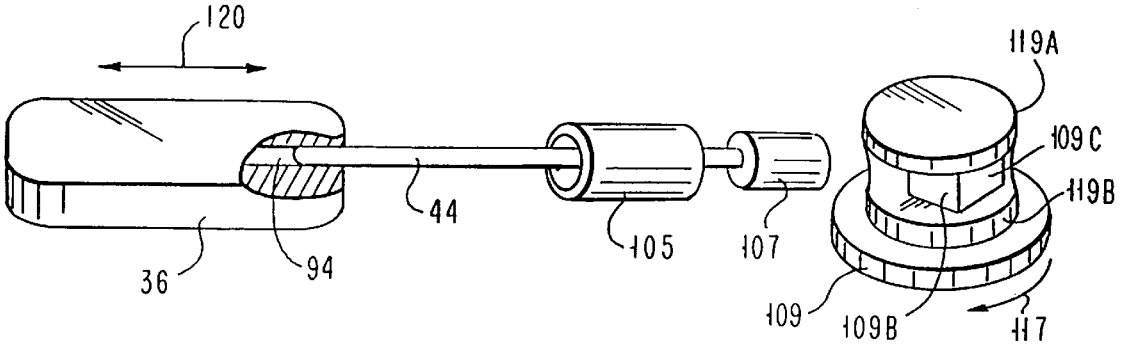
FIG. 9 is an expanded perspective view of some of the components of FIG. 7, illustrating the general shape of these components.

FIG. 9 is a side perspective view which illustrates the thumbwheel cam 109 in more detail. Spring 42 is not shown in this view. Circular "rims" 119A, 119B are located above and below the cam surfaces 109A–109D. Spring guide 107 enters the space adjacent the cam lobes between rims 119A and 119B, thereby locking the thumbwheel cam in place. During assembly the spring 42 and guide pin (plunger) 44 are depressed, the thumbwheel cam 109 inserted into the opening made for it in the tool body and then the spring 42/guide pin 44 are released. This causes the spring guide 107 at the aft end of the pin 44 to enter the space between the rims 119A, 119B and against the selected cam lobe, thereby locking the thumbwheel in place. Arrow 120 indicates the fore and aft longitudinal motion of the hammer 36.

The thumbwheel cam can be removed by removing the dust cap 113 and inserting a pin into opening 115 through hole 111 so as to depress the guide pin 44 forward. This allows the thumbwheel cam 109 to be partially withdrawn. Then by removing the pin to free the thumbwheel cam 109, cam 109 can be fully removed.

Figure 10:
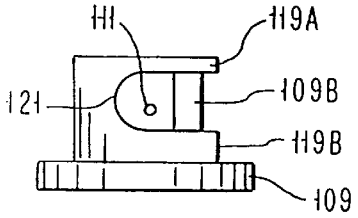
FIG. 10 is a front view of the cam thumb wheel of FIG. 9, illustrating the cuts therein which limit the rotation of the thumb wheel.

FIG. 10 is a front view of thumbwheel cam 109 showing a circular cut 121 on the front side of the cam lobes. A like cut is made on the opposite side of the cam lobes. Cuts 121 prevent the thumbwheel cam 109 from rotating more than 180°. In the embodiment shown in FIGS. 7–10, four cam lobe surfaces 109A–109D are shown, allowing four different magnitudes of impact force to be delivered to the chisel tool held by collet 96 (FIG. 6). In FIG. 8, the bottom surface of thumbwheel 109 is marked "H" for heavy impact force and "L" (not shown) for light impact force. Intermediate forces provided by cam lobes 109B and 109C are indicated by the small triangles.

While the embodiment shown uses four cam lobes, it will be understood that a greater (or lesser) number could be used depending on the degree of force and precision required for a particular engraving task.

The operation of this impact tool using the embodiment of FIGS. 7–10 is essentially the same as that using the spring-plunger assembly 38 of FIG. 1. As shaft 22 rotates, cam 30 rides against needle bearing 32, pushing hammer 36 in the aft direction, thereby compressing spring 42 by an amount determined by the cam lobe 109A–109D that is contacted by spring guide 107. During a small portion of the rotation of cam 30, cam 30 will not contact needle bearing 32. This is the time in which the hammer 36 rapidly moves forward to impact against the output shaft 48, delivering a force impulse to the chisel tool.

The foregoing detailed description has been directed to the teachings of my U.S. Pat. Nos. 4,030,556 and 5,449,044 and my copending application Ser. No. 08/846,888. The following description is directed to the invention claimed in the present application.

Figure 11:
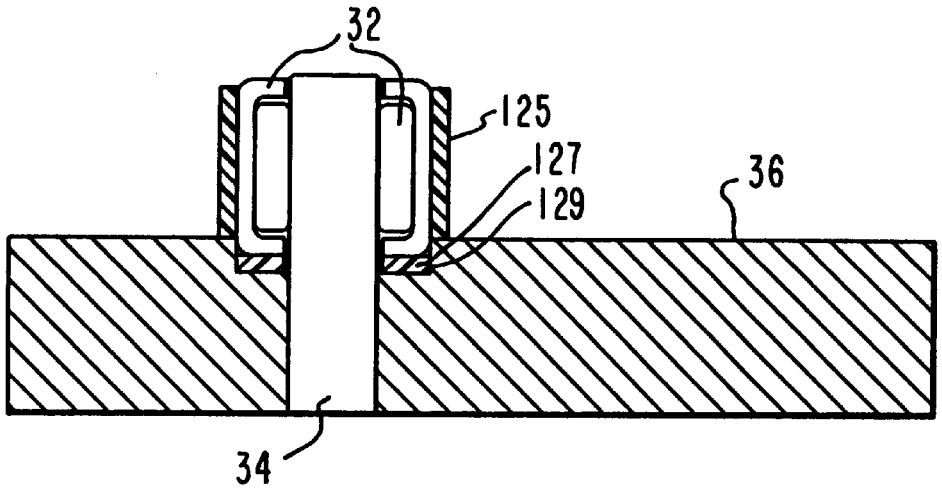
FIGS. 11 and 12 are directed to the present invention and illustrate the use of a resilient elastomeric coating or sleeve on the outer surface of the needle bearing attached to the hammer, in order to reduce impact shock due to the metal-metal contact.
Figure 12:
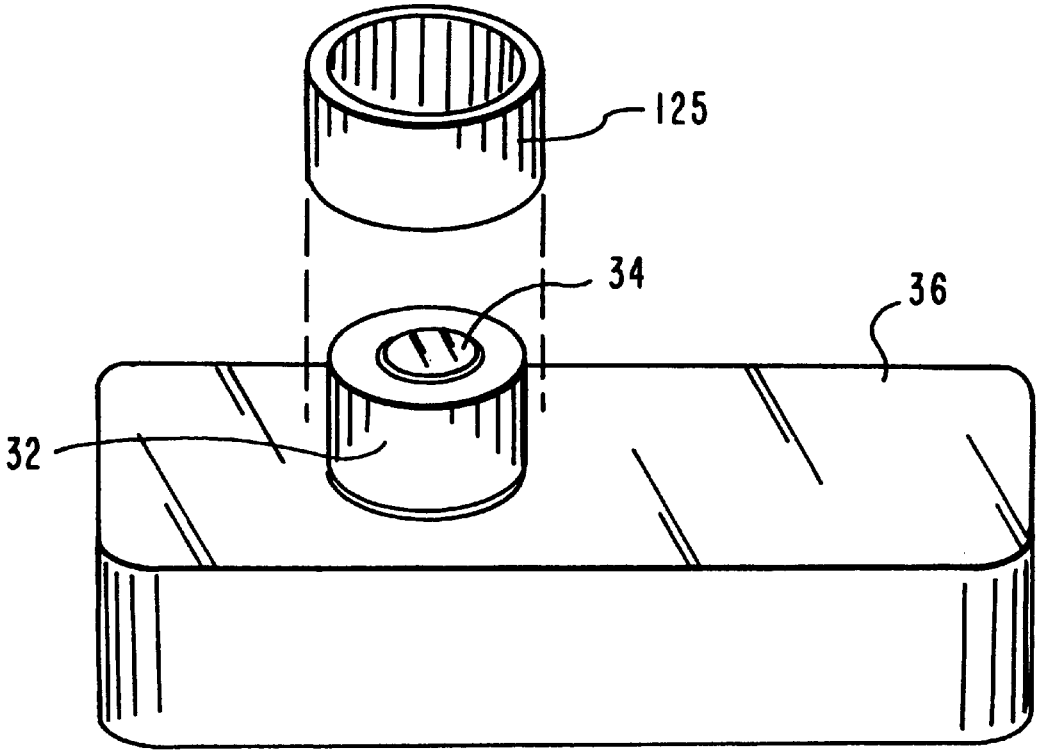

FIGS. 11 and 12 illustrate an improvement that increases the useful life of this tool, especially in those circumstances where the user over speeds the tool.

The tool, when used properly, i.e., with normal force and at a normal speed, will give satisfactory service over a long length of time. However, when used improperly or by a novice, or when used with a non-recommended power source, the tool can be over speeded. It has been discovered that an over speeded condition can shorten the life of one or more of the internal parts of the tool.

When the tool is over speeded, the hammer 36 does not have sufficient time to complete its intended cycle of movement. Instead of the hammer 36 being "cocked" by the cam 30 and then released to impact onto the output shaft 48, over speeding will cause the hammer needle bearing 32 (cam follower) to impact onto the cam 30 surface. This occurs because the cam 30 is being rotated faster than it was designed to rotate and will come into contact with needle bearing 32 before the hammer 36 can properly complete its cycle. When this occurs over an extended period of time, the needle bearing 32 can fail prematurely and the surface of cam 30 can be damaged.

In order to reduce the impact shock and extend the useful life of the tool, I have modified the outer surface of the needle bearing 32 with a resilient elastomeric coating 125. Coating 125 eliminates metal to metal contact between the needle bearing 32 and cam 30 and reduces the impact shock between these components when an over speeding condition occurs.

Coating 125 is of sufficient thickness and hardness to provide cushioning of any impact between the needle bearing 32 and the surface of cam 30. It can be provided on the surface of bearing 32 by different methods such as pulling it over the bearing (sleeve), or by casting it onto the bearing surface.

FIG. 11 is a sectional side view of the needle bearing-hammer assembly, showing the hammer 36, needle bearing 32 affixed to pin 34 (which is press-fit into hammer 36), and the elastomeric coating 125. A washer 127 (optional) is located in a recess 129 in the top surface of the hammer. Bearing 132 rests on washer 127, which provides a bearing surface for the needle bearing. Washer 127 can be nylon or another plastic material.

Coating 125 is made of an elastomeric material that is sufficiently hard that it will not slide or slip off the surface of bearing 32. However, it is preferred that coating 125 not be so hard that it will not provide a cushioning function. I have used urethane coatings having a hardness of about 40–50 durometers with success, but it is envisioned that the hardness range can be extended greatly—for example, about 20–80 durometers. Other suitable materials include nylon and other plastics.

Coating 125 of a desired length can be cut from a longer length of tubing and slipped over the bearing surface. If the tubing inside diameter is a bit undersized, the cut length can be stretched over the bearing surface and glued thereto to provide good bonding. As an alternative, bearing 32 can be put into a mold and liquid urethane can be added around it, and then hardened to provide coating 125.

The thickness of coating 125 is sufficient to provide cushioning while at the same time not being so thick that it is dimensionally unsuitable for the size of the tool and its components. For example, bearing 32 moves back and forth in the opening 90 in shelf 88, and the coating 125 must not be so thick as to impede the full longitudinal movement of hammer 36. In one example of a tool with a needle bearing of about ⅜ inch O.D., I have used a urethane coating 125 of about 1/32 inch wall thickness. If coating 125 is too thin, it will not provide much cushioning and the useful life of the tool will not be greatly extended.

FIG. 12 shows a sleeve-like elastomeric coating 125 being placed on the outer surface of needle bearing 32. Glue can be used to securely bond the sleeve coating 125 to the outer bearing surface.

Although the coating 125 has been illustrated by several examples, it will be appreciated that other materials and dimensions can be used to provide effective cushioning to reduce the harmful effects of repeated, undesired impacts between cam 30 and bearing 32.

While the invention has been described with respect to particular embodiments thereof, it will be apparent to those of skill in the art that variations may be made consistent with the gist and scope of the present invention. For example, the thumbwheel cam can be retained in tool body 12 by various means and differing cam lobe surfaces may be used. Further, the cushioning between cam 30 and bearing 32 can be provided by means and materials other than that which has been illustrated. An example is the use of an elastomeric cam 30. A suitable elastomeric material from which cam 30 can be formed is urethane of about 90A durometer. As with the elastomeric sleeve 125, the hardness of the elastomeric cam 30 can vary over a wide range while still being effective to reduce impact shock and wear when over speeding occurs. In addition to urethane, nylon and other plastics can also be used.

Having thus described my invention, what I claim as new and desire to secure by Letters Patent is:

1. An impact tool comprising:

rotary means adapted for being driven in a rotary motion, said rotary means including a drive shaft that is biased in a forward direction by a first spring and a first cam attached to said drive shaft, linear reciprocating means abutting said rotary means for converting said rotary motion to linear motion, said linear reciprocating means including a bearing in contact with said first cam, said bearing having an elastomeric coating thereon and being moved in a backward longitudinal direction as said first cam rotates, an output shaft having at one end thereof a holder for holding a cutting chisel, means for preventing rotation of said output shaft, a housing enclosing said rotary means, said output shaft and said linear reciprocating means, a striker that is movable in a backward longitudinal direction against a spring when said first cam rotates and a guide pin/spring assembly including a guide pin and a second spring where said guide pin/spring assembly is in contact with said striker and causes said striker to move in a forward longitudinal direction for providing an impact force to said output shaft, said second spring abutting at one end thereof a shoulder of said guide pin and at the other end thereof said striker, said guide pin and said second spring causing said striker to move in a forward longitudinal direction for providing a force impulse to said output shaft and thereby to a cutting chisel tool held by said output shaft, cam means for establishing a compressive force on said second spring when said striker moves backward in a longitudinal direction.

2. The impact tool of claim 1, further including a sleeve bearing enclosing a substantial portion of said drive shaft.

3. The impact tool of claim 2, where said striker is connected to said bearing and moves in a longitudinal direction toward said guide pin/spring assembly as said bearing moves in that direction.

4. The impact tool of claim 1, wherein said output shaft further includes an aperture in which is located a removable collet for holding said cutting chisel.

5. The impact tool of claim 1, where said cam means includes a plurality of cam lobes, one of which abuts said guide pin during operation of said impact tool.

6. The impact tool of claim 5, where said cam means is attached to a wheel that can be rotated to bring a selected cam lobe into contact with said guide pin.

7. The impact tool of claim 6, where said cam lobes are flat surfaces, and the surface of said guide pin abutting one of said cam lobes includes a flat surface.

8. The impact tool of claim 1, where said guide pin is of generally constant diameter except at its aft end where it is of larger diameter and includes a shoulder against which said second spring abuts, said larger diameter aft end portion of said guide pin including a flat surface that contacts a flat surface of said cam means, and further including a bushing having a sliding fit to said larger diameter portion of said guide pin.

9. The impact tool of claim 1, where said striker has an opening therein into which the forward end of said guide pin is slidably located.

10. The impact tool of claim 1, further including a shelf for substantially preventing the movement of said striker in a direction transverse to its longitudinal motion when striking said output shaft and recoiling therefrom, said striker having a guide means at the striker surface that is contacted by said guide pin, at least a portion of said guide pin being located in said guide means during longitudinal movement of said striker.

11. A miniature impact tool comprising:

rotary means adapted for being driven in a rotary motion, said rotary means including a drive shaft adapted to be driven in a rotary motion, a first cam connected to said drive shaft and a sleeve bearing having a sliding fit contact to said drive shaft, linear reciprocating means for converting said rotary motion to linear longitudinal motion, said linear reciprocating means including a cam follower abutting said first cam, cushioning means between said cam follower and said first cam, a striker connected to said cam follower, and a spring/guide pin assembly abutting a rear surface of said striker, said assembly including a spring and a guide pin, an output shaft including a tool holder for holding a chisel, said output shaft being struck by said striker during said linear longitudinal motion to cause said chisel to impact a workpiece against which it is held, a housing enclosing said rotary means, said linear reciprocating means and a portion of said tool holder, means adjacent another surface of said striker for limiting substantial movement of said striker in a direction toward said drive shaft, wherein said striker has a recess in said rear surface thereof in which a portion of said guide pin fits, and a second cam in contact with the aft end of said guide pin for establishing the magnitude of the force which propels said striker against said output shaft.

12. The miniature impact tool of claim 11, where said tool holder includes removable collet means for accommodating cutting tools of different shank size and shape.

13. The miniature impact tool of claim 11, where said cam follower further includes a bearing assembly abutting said first cam and means connecting said bearing assembly and said striker, and wherein said cushioning means is an elastomeric coating located on said bearing assembly.

14. The miniature impact tool of claim 11, where said tool holder is a generally cylindrical shaft, there being elastomeric cushioning rings encircling and abutting a portion of said tool holder.

15. The miniature impact tool of claim 14, further including means for preventing rotation of said tool holder, and bias means for biasing said drive shaft in a forward longitudinal direction.

16. The miniature impact tool of claim 11, where said spring is under tension when said striker moves in an aft longitudinal direction, said second cam including tension means for establishing the magnitude of said tension.

17. The miniature impact tool of claim 16, where said tension means includes a plurality of flat cam lobes on said second cam and means for bringing a selected one of said flat cam lobes into contact with the aft end of said guide pin.

18. The miniature impact tool of claim 17, including means for rotating said second cam to bring a selected one of said flat cam lobes into contact with the aft end of said guide pin, the tension on said spring being determined by the flat cam lobe in contact with said guide pin.

19. The miniature impact tool of claim 18, where said spring is held between said striker and a shoulder at the aft end of said guide pin, and wherein rotation of said second cam changes the distance between said striker and said second cam.

20. An impact tool comprising:

rotary means adapted for being driven in a rotary motion, said rotary means including a drive shaft and a cam attached to said drive shaft, linear reciprocating means abutting said rotary means for converting said rotary motion to linear motion, said linear reciprocating means including a cam follower in contact with said cam, said cam follower being moved in a backward longitudinal direction as said cam rotates, an output shaft having at one end thereof a holder for holding a cutting chisel, means for preventing rotation of said output shaft, a housing enclosing said rotary means, said output shaft and said linear reciprocating means, a striker that is movable in a backward longitudinal direction against a spring when said cam rotates and a pin/spring assembly including a pin and a spring where said pin/spring assembly is in contact with said striker and causes said striker to move in a forward longitudinal direction for providing an impact force to said output shaft, cushioning means for preventing adverse contact between said cam and said cam follower when said striker moves in a forward longitudinal direction, and means for establishing the compressive force on said spring when said striker moves backward in a longitudinal direction.

21. The impact tool of claim 20, where said cushioning means is an elastomeric coating or sleeve on said cam follower.

22. The impact tool of claim 20, where said cam is made of elastomeric material to provide said cushioning means.

23. The impact tool of claim 22, further including a sleeve bearing enclosing a substantial portion of said drive shaft.

24. The impact tool of claim 20, where said means for establishing the compressive force on said spring is a cam having a plurality of cam lobes, one of which abuts said pin during operation of said impact tool.

25. The impact tool of claim 20, where said striker has an opening therein into which the forward end of said guide pin is slidably located.

26. The impact tool of claim 20, further including means for substantially preventing the movement of said striker in a direction substantially transverse to its longitudinal motion when striking said output shaft and recoiling therefrom.

* * * * *